US011769405B2

(12) United States Patent
Maeda

(10) Patent No.: US 11,769,405 B2
(45) Date of Patent: Sep. 26, 2023

(54) COMMUNICATION DEVICE AND COMMUNICATION METHOD

(71) Applicant: Mitsubishi Electric Corporation, Tokyo (JP)

(72) Inventor: Takashi Maeda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 17/698,039

(22) Filed: Mar. 18, 2022

(65) Prior Publication Data

US 2023/0146213 A1 May 11, 2023

(30) Foreign Application Priority Data

Nov. 9, 2021 (JP) ..... 2021-182272

(51) Int. Cl.
*G08G 1/0967* (2006.01)
*G08G 1/01* (2006.01)
*G08G 1/16* (2006.01)

(52) U.S. Cl.
CPC ..... *G08G 1/096783* (2013.01); *G08G 1/0141* (2013.01); *G08G 1/096791* (2013.01); *G08G 1/166* (2013.01)

(58) Field of Classification Search
CPC ..... G08G 1/096783; G08G 1/0141; G08G 1/096791; G08G 1/166
See application file for complete search history.

(56) References Cited

U.S. PATENT DOCUMENTS 6,591,192 B2 * 7/2003 Okamura ..... G08G 1/166 340/436
8,838,378 B2 * 9/2014 Yuasa ..... G01C 21/3492 701/414

(Continued)

FOREIGN PATENT DOCUMENTS

JP 2008-123367 A 5/2008
JP 4345832 B2 10/2009
JP 2010-33346 A 2/2010

OTHER PUBLICATIONS

Japanese Office Action dated Jan. 31, 2023 in Japanese Application No. 2021-182272.

*Primary Examiner* — Chico A Foxx
(74) *Attorney, Agent, or Firm* — Sughrue Mion, PLLC; Richard C. Turner

(57) ABSTRACT

An object is to share information of detected obstacles on a road among communication devices, using efficient communication. A communication device according to the present disclosure includes: a wireless receiving unit for receiving wireless information including first obstacle information of a first obstacle which is at least one obstacle, from outside; a first obstacle extraction unit for extracting the first obstacle information from the wireless information; a second obstacle detection unit for detecting second obstacle information of a second obstacle which is at least one obstacle present in an own surrounding area by a sensor; and an overlap information removing unit which, if there is overlap obstacle information between the first obstacle information and the second obstacle information, removes the overlap obstacle information from the second obstacle information, to generate difference obstacle information.

12 Claims, 8 Drawing Sheets

(56) References Cited

U.S. PATENT DOCUMENTS

| | | | | |
|---|---|---|---|---|
| 9,552,731 | B2 * | 1/2017 | Sakata | G08G 1/166 |
| 10,002,532 | B2 * | 6/2018 | Tandai | H04W 4/029 |
| 10,771,940 | B2 * | 9/2020 | Onishi | G08G 1/0965 |
| 10,823,574 | B2 * | 11/2020 | Shimotsuma | G08G 1/096783 |
| 11,353,579 | B2 * | 6/2022 | Shi | G08G 1/096783 |
| 2008/0114531 | A1 * | 5/2008 | Kagawa | G08G 1/163 701/119 |
| 2010/0036595 | A1 * | 2/2010 | Coy | G08G 1/0104 701/119 |
| 2010/0099353 | A1 | 4/2010 | Komori | |
| 2015/0269844 | A1 * | 9/2015 | Arndt | G08G 1/052 340/435 |
| 2017/0345298 | A1 * | 11/2017 | Tandai | H04W 4/021 |
| 2018/0347992 | A1 * | 12/2018 | Shimotsuma | G08G 1/096783 |
| 2019/0339082 | A1 * | 11/2019 | Doig | G08G 1/0141 |
| 2019/0347809 | A1 * | 11/2019 | Sato | G06V 20/52 |
| 2019/0380014 | A1 * | 12/2019 | Onishi | G08G 1/096791 |
| 2020/0072968 | A1 * | 3/2020 | Shi | G01S 13/931 |
| 2020/0092693 | A1 * | 3/2020 | Zhang | G08G 1/0112 |
| 2020/0104289 | A1 * | 4/2020 | Premawardena | H04W 4/44 |
| 2020/0175863 | A1 * | 6/2020 | Sakurada | G08G 1/0133 |
| 2021/0080558 | A1 * | 3/2021 | Gosala | G01S 13/723 |
| 2022/0260999 | A1 * | 8/2022 | Hattori | G05D 1/0274 |
| 2023/0042820 | A1 * | 2/2023 | Gurusamy | G06F 16/29 |

* cited by examiner

COMMUNICATION DEVICE AND COMMUNICATION METHOD

BACKGROUND OF THE INVENTION

1. Field of the Invention

The present disclosure relates to a communication device and a communication method.

2. Description of the Background Art

In recent years, various systems have been developed for preventing collision that can occur between vehicles or between a vehicle and a pedestrian beforehand or reducing impact at the time of collision. In such systems, it is important to accurately and immediately detect an object as an obstacle to traveling of an own vehicle, such as another vehicle or a pedestrian present around the own vehicle. As detection means for obstacles, a camera, a radar sensor, and the like are provided to the vehicle, and an obstacle that might hamper traveling of the own vehicle is detected using image information, radar information, and the like.

However, due to a factor such as a sensor detection area or a blind spot from the own vehicle, there is limitation in obstacle detection by the own vehicle alone. Therefore, technology for mutually acquiring and sharing obstacle information from other vehicles, roadside devices, and the like using vehicle-to-vehicle communication, road-to-vehicle communication, and the like, is being considered.

In such a system for sharing obstacle information, own detected obstacle information is mutually transmitted/received to/from another vehicle having a communication device and traveling near the own vehicle, a roadside device provided on a roadside, and the like. Therefore, a wide communication band is needed at a place such as an intersection having a large traffic volume.

In a road condition detection system described in Patent Document 1, in order to solve the above problem, at the time of transmitting obstacle information to another vehicle or a roadside device, information about the obstacle detection area of the other vehicle or the roadside device is received, and information obtained by removing information about obstacles in the same detection area is transmitted to the other vehicle, the roadside device, or the like, whereby the whole transmission amount is reduced.

Patent Document 1: Japanese Patent No. 4345832

In the road condition detection system described in Patent Document 1, when sharing obstacle information with another vehicle or a roadside device around the own vehicle, it is necessary to mutually communicate not only the detected obstacle information but also information of the obstacle detection area by separately using a dedicated communication message. Therefore, at a place such as an intersection having a large traffic volume, the communication message amount increases, leading to communication congestion.

SUMMARY OF THE INVENTION

The present disclosure has been made to solve the above problem, and an object of the present disclosure is to provide a communication device and a communication method that enable efficient communication.

A communication device according to one aspect of the present disclosure includes: a wireless receiving unit for receiving wireless information including first obstacle information of a first obstacle which is at least one obstacle, from outside; a first obstacle extraction unit for extracting the first obstacle information from the wireless information; a second obstacle detection unit for detecting second obstacle information of a second obstacle which is at least one obstacle present in an own surrounding area by a sensor; and an overlap information removing unit which, if there is overlap obstacle information between the first obstacle information and the second obstacle information, removes the overlap obstacle information from the second obstacle information, to generate difference obstacle information.

A communication method according to another aspect of the present disclosure includes: a wireless receiving step of receiving wireless information including first obstacle information of a first obstacle which is at least, one obstacle, from outside; a first obstacle extraction step of extracting the first obstacle information from the wireless information; a second obstacle detection step of detecting second obstacle information of a second obstacle which is at least one obstacle present in an own surrounding area by a sensor; and an overlap information removing step of, if there is overlap obstacle information between the first obstacle information and the second obstacle information, removing the overlap obstacle information from the second obstacle information, to generate difference obstacle information.

In the communication device and the communication method according to the present disclosure, information overlapping with first obstacle information transmitted from another communication device is removed from second obstacle information detected by the own communication device, to generate difference obstacle information, and the difference obstacle information is transmitted to be shared with communication devices of other vehicles and the like. Thus, effects of enabling reduction in the data communication amount and enabling efficient communication are provided.

DETAILED DESCRIPTION OF THE PREFERRED EMBODIMENTS OF THE INVENTION

Figure 1:
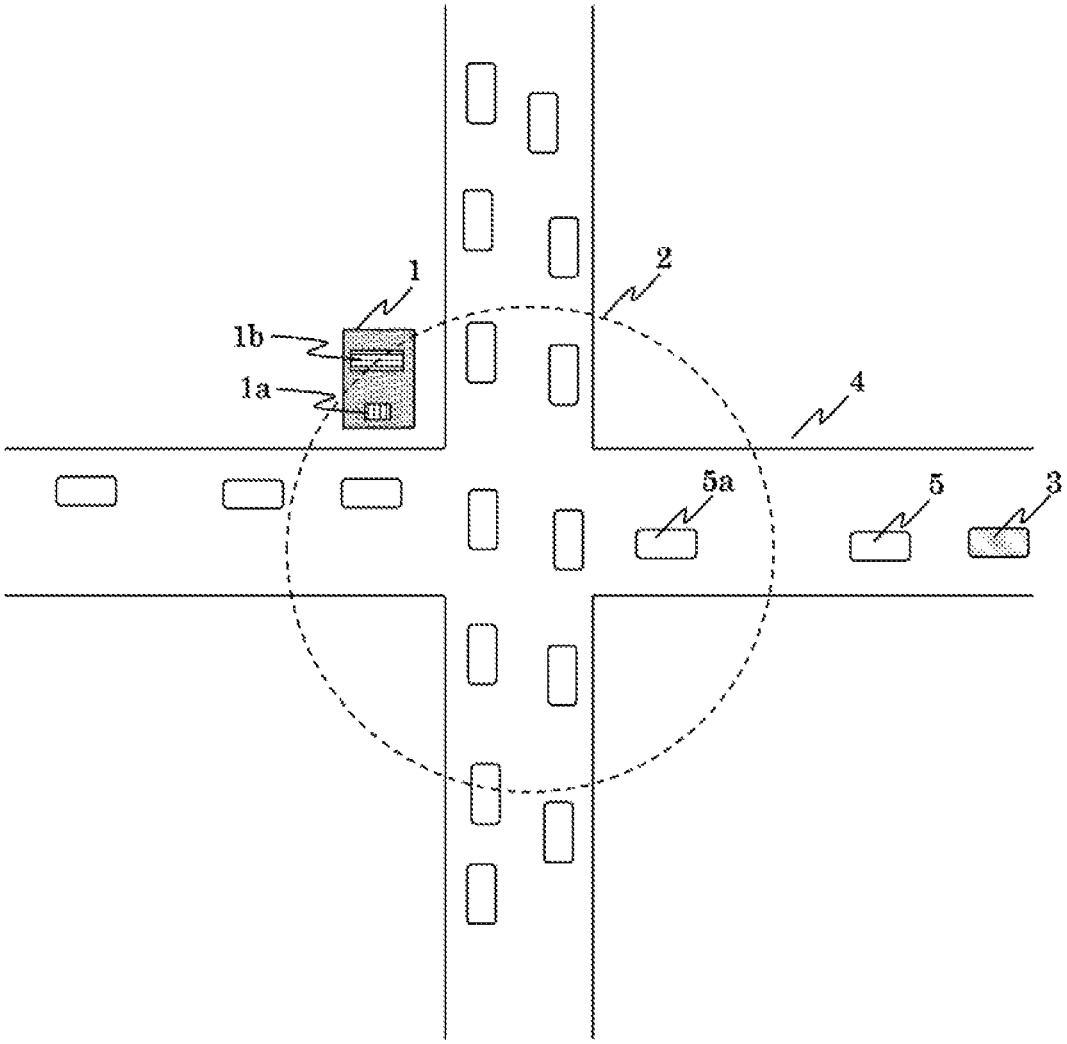
FIG. 1 is a schematic diagram showing an example in which a communication device according to the first embodiment of the present disclosure is used.

Hereinafter, to describe the present disclosure in more detail, embodiments of the present disclosure will be described with reference to the accompanying drawings. In all the drawings for illustrating the embodiments of the present disclosure, components having the same function are denoted by the same reference character and description thereof will not be repeated.

First Embodiment

FIG. 1 is a schematic diagram snowing an example in which a communication device 100 according to the first embodiment is used. At an intersection in FIG. 1, a roadside device 1 including a roadside sensor 1*a* and a communication unit 1*b* is provided, and detects an obstacle such as a pedestrian or a vehicle in a detection area 2 of the roadside sensor and transmits information about the obstacle, i.e., the kind, position, speed, orientation, detection accuracy, and the like about the obstacle, via wireless communication. Here, an obstacle as a transmission target by the roadside device 1 may be referred to as a first obstacle and information about the obstacle transmitted by the roadside device 1 may be referred to as first obstacle information.

Examples of the roadside sensor 1*a* provided to the roadside device 1 include a millimeter-wave radar, an image sensor, and a camera. The roadside sensor 1*a* detects, as first obstacle information, information such as the kind of a vehicle traveling on a road such as an intersection, the vehicle position, the vehicle speed, the vehicle advancing direction, and detection accuracy. In addition, the roadside sensor 1*a* similarly detects, as first obstacle information, information such as a pedestrian walking on a road, i.e., the pedestrian position, the pedestrian walking speed, the pedestrian walking direction, and detection accuracy.

Various kinds of information detected by the roadside sensor 1*a* are wirelessly transmitted as wireless information by the communication unit 1*b* in the roadside device 1 to a vehicle traveling near the roadside device 1, and the like. Such various kinds of information detected by the roadside sensor 1*a* include first obstacle information.

Figure 2:
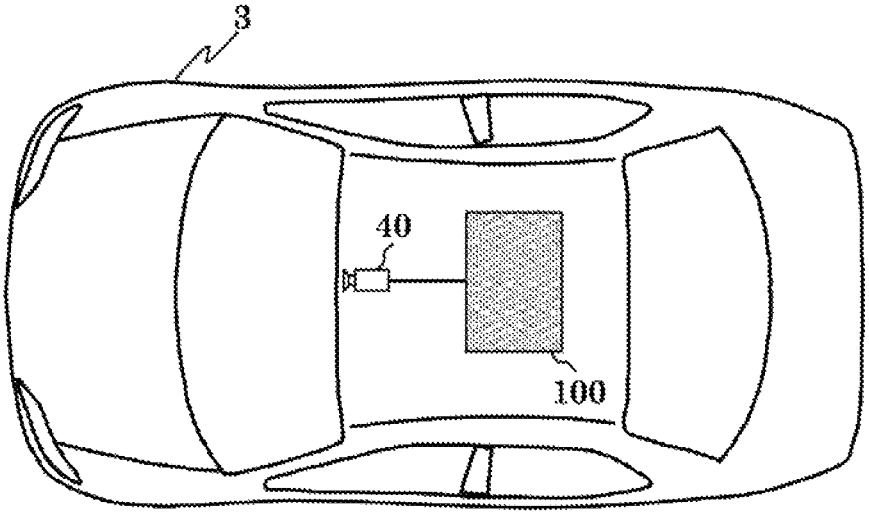
FIG. 2 is a schematic diagram of a vehicle provided with the communication device according to the first embodiment.

As shown in a vehicle schematic diagram in FIG. 2, as in the roadside device 1, an own vehicle 3 is provided with an on-vehicle sensor 40 and the communication device 100 according to the first embodiment. In a detection area 4 of the on-vehicle sensor, an obstacle such as a pedestrian or another vehicle 5 is detected by the on-vehicle sensor 40. An obstacle as a detection target by the on-vehicle sensor 40 may be referred to as a second obstacle. In addition, information of the detected obstacle around the own vehicle 3 may be referred to as second obstacle information.

The communication device 100 transmits second obstacle information to the roadside device 1, the other vehicle 5 traveling near the own vehicle 3, and the like, via wireless communication, under a certain condition.

Configuration of Communication Device According to First Embodiment

Figure 3:
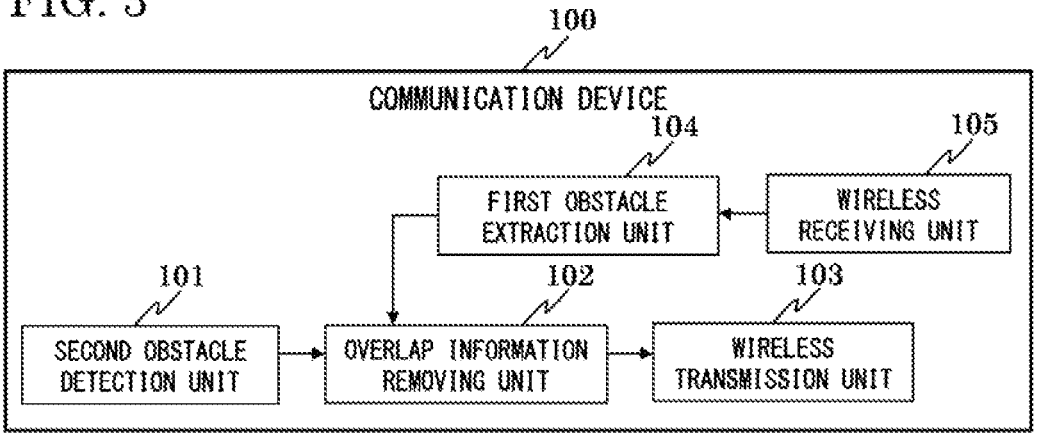
FIG. 3 is a function block diagram showing the configuration of the communication device according to the first embodiment.

FIG. 3 is a function block diagram showing the configuration of the communication device 100 according to the first embodiment, provided to the vehicle. The communication device 100 according so the first embodiment includes a second obstacle detection unit 101, an overlap information removing unit 102, a wireless transmission unit 103, a first obstacle extraction unit 104, and a wireless receiving unit 10').

The wireless receiving unit 105 receives information transmitted from communication devices provided to the roadside device 1, the other vehicle 5, and the like.

The second obstacle detection unit 101 detects obstacles present around the own vehicle 3 by the on-vehicle sensor 40. The on-vehicle sensor 40 may be, for example, a radar sensor. As shown in FIG. 2, the radar sensor is generally provided on the front side of the own vehicle 3 so that an area frontward of the own vehicle 3 can be detected. The radar sensor radiates radio waves frontward of the own vehicle 3 and detects a reflected wave based on the radiated radio waves, thereby detecting a second obstacle present around the own vehicle 3.

As the on-vehicle sensor 40, an image sensor may be used. On the basis of image information acquired by the image sensor provided on the front side of the own vehicle 3, the second obstacle detection unit 101 detects information of a second obstacle present around the own vehicle 3, such as the position, speed, and shape of the second obstacle. Further, if the image sensor is provided also on the lateral sides and the rear side in addition to the front side, the second obstacle detection unit 101 can also detect a second obstacle present therearound on the lateral sides and the rear side. Alternatively, the on-vehicle sensor 40 may be an ultrasonic sensor.

The first obstacle extraction unit 104 extracts first obstacle information detected by a sensor provided to a transmission source device, from wireless information received by the wireless receiving unit 105. An example of the transmission source device is the roadside device 1 which is provided with the roadside sensor 1*a* and wirelessly transmits obstacle information detected by the roadside sensor 1*a*, i.e., first obstacle information, to the outside via the communication unit 1*b*.

The overlap information removing unit 102 removes information of an overlap obstacle included in first obstacles extracted by the first obstacle extraction unit 104, from among second obstacles detected by the second obstacle detection unit 101, to generate difference obstacle information.

The wireless transmission unit 103 transmits the difference obstacle information generated by the overlap information removing unit 102, to communication devices provided to the roadside device 1, the other vehicle 5, and the like present outside the communication device 100 according to the first embodiment.

Communication Method According to First Embodiment

Figure 4:
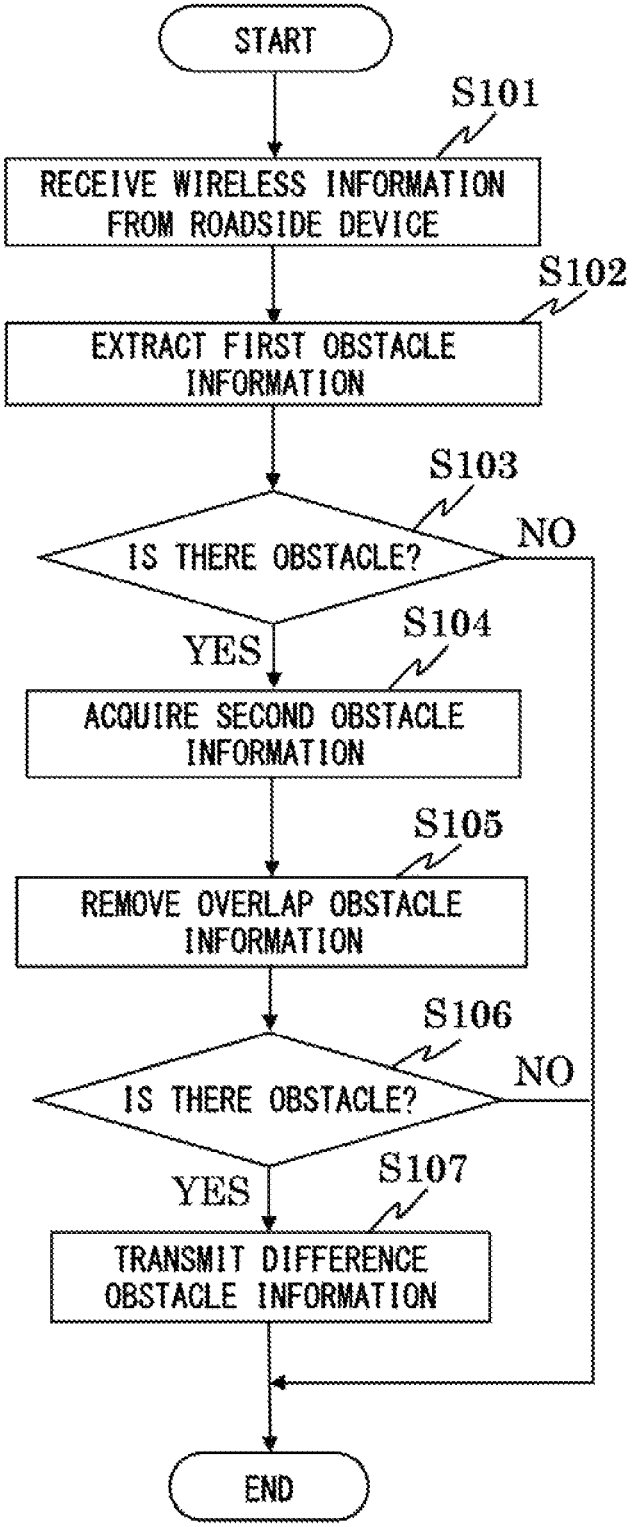
FIG. 4 is a flowchart illustrating a communication method according to the first embodiment.

A communication method according to the first embodiment will be described with reference to a flowchart in FIG. 4. The flowchart in FIG. 4 is regularly started per wireless transmission cycle, e.g., 100 ms.

In step S101, the wireless receiving unit 105 of the communication device 100 provided to the own vehicle 3 receives wireless information transmitted from the communication unit 1*b* of the roadside device 1.

In step S102, the communication device 100 extracts first obstacle information detected by the roadside sensor 1*a* of the roadside device 1 from the wireless information received from the roadside device 1.

In step S103, whether or not first obstacle information detected by the roadside sensor 1*a* of the roadside device 1 has been successfully extracted in step S102, i.e., whether or not first obstacle information is present in the wireless information, is determined. If first obstacle information is present in the wireless information and thus has been successfully detected, i.e., in a case of YES in step S103, the process proceeds to step S104. On the other hand, if first obstacle information is not present in the wireless information and thus has not been detected, i.e., in a case of NO in step S103, the process is ended.

In step S104, the communication device 100 acquires second obstacle information about a second obstacle detected by the on-vehicle sensor 40.

In step S105, the communication device 100 removes, from the second obstacle information acquired in step S104, obstacle information included in the first obstacle information extracted in step S102, i.e., overlap obstacle information, to generate difference obstacle information.

As an example of a method for identifying each obstacle, processing may be performed such that, if differences in the positions, speeds, orientations, and the like of detected obstacles fall within a predetermined range, such obstacles are determined as an identical obstacle. However, this processing method is merely an example and the identifying method is not limited thereto.

In step S106, whether or not there is difference obstacle information generated in step S105 is determined. The reason is that there can be a case where the second obstacle information detected by the on-vehicle sensor 40 provided to the own vehicle 3 completely coincides with she first obstacle information detected by the roadside sensor 1*a* of the roadside device 1, and in this case, there is no difference obstacle information.

If there is difference obstacle information generated in step S105, i.e., in a case of YES in step S106, step S107 is performed. On the other hand, if there is no difference obstacle information, i.e., in a case of NO in step S106, the process is ended.

In step S107, the communication device 100 wirelessly transmits the difference obstacle information generated in step S105, to the roadside device 1 outside the communication device 100, the other vehicle 5 in the intersection, and the like.

In the above description, the communication method according to the first embodiment has been described.

An example of the communication method according to the first embodiment will be shown below. It is assumed that first obstacle information detected by the roadside sensor 1*a* of the roadside device 1 is represented by the following set $S_1$.

$S_1=\{a_1, a_2, a_3, a_4, a_5, a_6, a_7, a_8, a_9, \ldots\}$

Here $a_1, a_2, a_3, \ldots$ are information of individual obstacles on a road, detected by the roadside sensor 1*a*.

Meanwhile, it is assumed that second obstacle information which is information of obstacles present around the own vehicle 3, detected by the on-vehicle sensor 40 provided to the own vehicle 3, is represented by the following set $S_2$.

$S_2=\{b_1, b_2, b_3, b_4, b_5, b_6, b_7, b_8, b_9, \ldots\}$

Here, $b_1, b_2, b_3, \ldots$ are information of individual obstacles present around the own vehicle 3, detected by the on-vehicle sensor 40.

Then, it is assumed that, between respective obstacle information pieces of the first obstacle information $S_1$ and the second obstacle information $S_2$, the following information pieces coincide with each other.

$a_2=b_2, a_4=b_4, a_6=b_6, a_9=b_9, \ldots$

That is, in the second obstacle information $S_2$, there are $b_2, b_4, b_6, b_9, \ldots$ which are overlap obstacle information between the first obstacle information $S_1$ and the second obstacle information $S_2$.

For identifying obstacles in the first obstacle information $S_1$ and the second obstacle information $S_2$, as described above, processing may be performed such that, if differences in the positions, speeds, orientations, and the like of detected obstacles fall within a predetermined range, such obstacles are determined as an identical obstacle.

That is, if differences between the position, speed, and orientation of the obstacle $a_2$ which is one element of the first obstacle information $S_1$ and the position, speed, and orientation of the obstacle $b_2$ which is one element of the second obstacle information $S_2$ each fall within a predetermined range, the obstacle $a_2$ which is one element of the first obstacle information $S_1$ and the obstacle $b_2$ which is one element of the second obstacle information $S_2$ can be determined as identical obstacle information, i.e., overlap obstacle information.

By removing the obstacle information overlapping with the first obstacle information $S_1$ from the second obstacle information $S_2$, the following difference obstacle information $S_d$ is generated.

$S_d=\{b_1, b_3, b_5, b_7, b_8, \ldots\}$

The difference obstacle information $S_d$ is wirelessly transmitted to the outside of the own vehicle 3 from the wireless transmission unit 103 of the communication device 100 provided to the own vehicle 3.

A case where another vehicle 5*a* traveling at the intersection shown in FIG. 1 receives obstacle information will be described below. The other vehicle 5*a* is located in the detection area 2 of the roadside sensor of the roadside device 1 and at the same time, is located also in the detection area 4 of the on-vehicle sensor of the own vehicle 3.

Therefore, information $a_{t1}$ about the other vehicle 5*a* detected as an obstacle is included in the first obstacle information $S_1$ detected by the roadside sensor 1*a* of the roadside device 1. In addition, information $b_{t1}$ about the other vehicle 5*a* detected as an obstacle is included in the second obstacle information $S_2$ detected by the on-vehicle sensor 40 of the own vehicle 3. The information $a_{t1}$ and the information $b_{t1}$ are information based on the other vehicle 5*a* that is the identical obstacle. Therefore, when the own vehicle 3 wirelessly transmits the second obstacle information $S_2$ to the outside via the wireless transmission unit 103, the difference obstacle information obtained by removing the information $b_{t1}$ which is the overlap information about the other vehicle 5*a* is wirelessly transmitted, and thus efficient communication can be achieved.

Next, a case where the other vehicle 5*a* receives obstacle information from the outside will be described below. As described above, the other vehicle 5*a* is located in an area where wireless information can be received from both of the roadside device 1 and the communication device 100 provided to the own vehicle 3.

Supposing that the own vehicle 3 only has a function of merely transmitting information (second obstacle information) of an obstacle around the own vehicle 3 detected by the on-vehicle sensor 40, in the above example, the other vehicle 5*a* receives combined obstacle information $S_s$ obtained by merely combining the first obstacle information $S_1$ transmitted from the roadside device 1 and the second obstacle information $S_2$ transmitted from the own vehicle 3. That is, the other vehicle 5*a* receives the following information.

$S_s=S_1+S_2=\{a_1, a_2, a_3, \ldots, b_1, b_2, b_3, \ldots\}$

However, since overlap obstacle information is included in the combined obstacle information $S_s$, the data communication amount increases, leading to communication congestion.

On the other hand, in a case where the own vehicle 3 is provided with the communication device 100 according to the first embodiment, corrected combined obstacle information $S_a$ obtained by combining the first obstacle information $S_1$ transmitted from the roadside device 1 and the difference obstacle information $S_d$ transmitted from the own vehicle 3 no the other vehicle 5*a* is such information that overlap obstacle information therebetween has been removed, and therefore, in the above example, this information is represented as follows.

$S_u=S_1+S_d=\{a_1, a_2, a_3, \ldots, b_1, b_3, b_5, b_7, b_8, \ldots\}$

That is, the other vehicle 5*a* receives the corrected combined obstacle information $S_u$ that does not include overlap obstacle information at all. Thus, efficient communication not including unnecessary overlap information can be achieved.

Effects of First Embodiment

As described above, in the communication device 100 and the communication method according to the first embodiment, obstacle information overlapping with first obstacle information transmitted from another communication device, e.g., the roadside device 1, is removed from second obstacle information detected by the on-vehicle sensor 40 of the own vehicle 3, to generate difference obstacle information, and the difference obstacle information is transmitted to be shared with the communication device of another vehicle, and the like. Thus, it becomes possible to reduce the data communication amount, and in addition, since a communication message need not be separately transmitted, an effect of enabling efficient communication is also provided.

Second Embodiment

Figure 5:
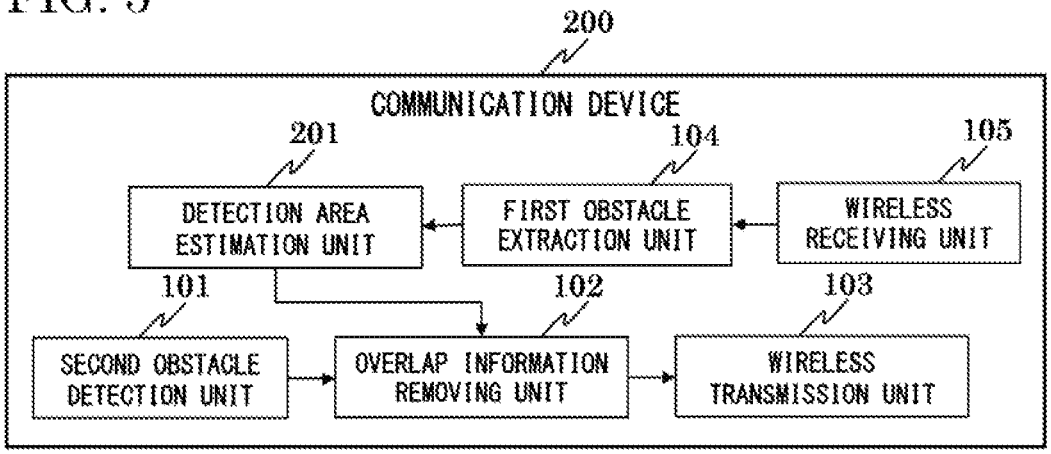
FIG. 5 is a function block diagram showing the configuration of a communication device according to the second embodiment of the present disclosure.

FIG. 5 is a function block diagram showing the configuration of a communication device 200 according to the second embodiment of the present disclosure. The communication device 200 shown in FIG. 5 further includes a detection area estimation unit 201 in addition to the configuration of the communication device 100 according to the first embodiment. For the same components as those in the communication device 100 according to the first embodiment, description is omitted.

On the basis of first obstacle information extracted by the first obstacle extraction unit 104 from wireless information transmitted from another communication device, the detection area estimation unit 201 estimates a first obstacle detection area which is an area where the first obstacle has been detected by a sensor provided to the other communication device. As an example, in a case where the other communication device is the roadside device 1, a detection area where the first obstacle has been detected by the roadside sensor 1*a* provided to the roadside device 1 is estimated as the first obstacle detection area.

Communication Method According to Second Embodiment

Figure 6:
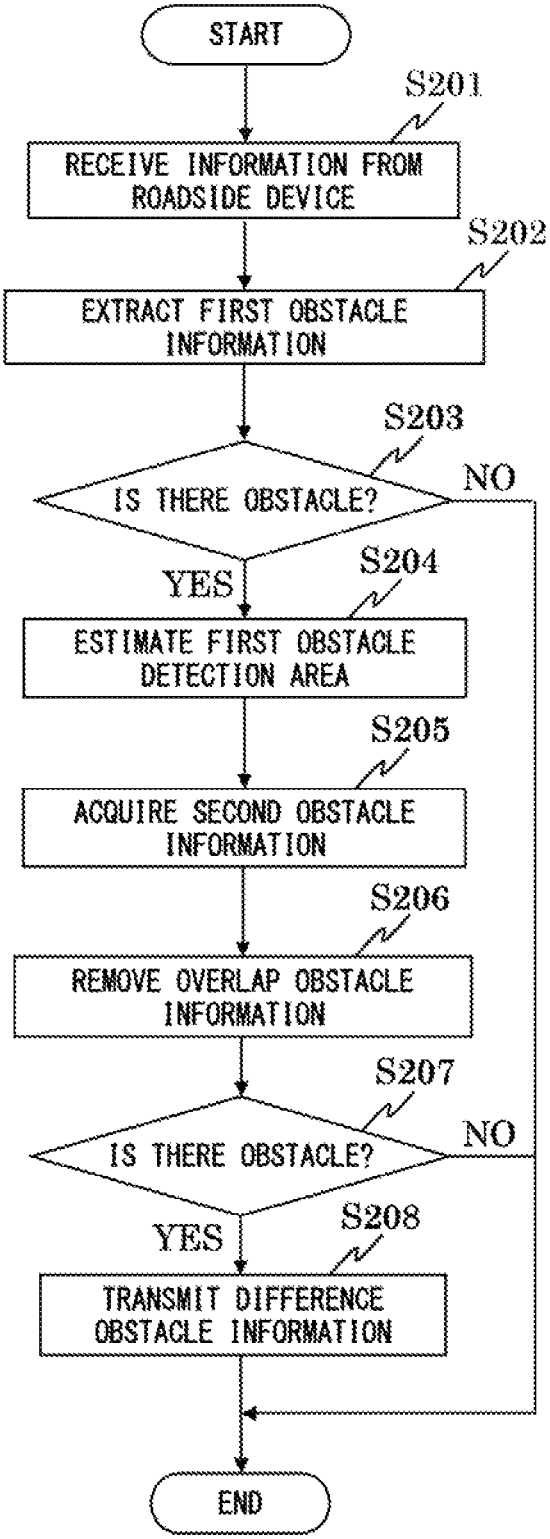
FIG. 6 is a flowchart illustrating a communication method according to the second embodiment.

With reference to a flowchart in FIG. 6, a communication method according to the second embodiment will be described. It is noted that operations in steps S201 to S203 in the flowchart in FIG. 6 are respectively the same as those in steps S101 to S103 in the flowchart in FIG. 4 of the first embodiment, and operations in steps S205, S207, and S208 in the flowchart in FIG. 6 are respectively the same as those in steps S104, S106, and S107 in the flowchart in FIG. 4, and therefore description thereof is omitted.

In step S204, on the basis of the first obstacle information extracted by the first obstacle extraction unit 104 from the wireless information transmitted from the other communication device, the detection area estimation unit 201 estimates the first obstacle detection area which is an area where the first obstacle has been detected by the sensor provided to the other communication device.

As an example of a method for estimating the first obstacle detection area by the detection area estimation unit 201, processing may be performed such that the maximum and minimum latitudes and longitudes are calculated from position information of all the target obstacles and a rectangular area specified by the latitudes and the longitudes is estimated as the sensor detection area. However, this processing method is merely an example and the estimation method is not limited thereto.

In step S206, if there is an overlap detection area between the above first obstacle detection area and a second obstacle detection area which is an area where the second obstacle included in the second obstacle information has been detected, the overlap information removing unit 102 removes, as overlap obstacle information, obstacle information included in the overlap detection area, from the second obstacle information, to generate difference obstacle information.

In the above description, the communication method according to the second embodiment has been described.

In the above processing by the overlap information removing unit 102 in which obstacle information overlapping with the first obstacle information is removed from the second obstacle information, sameness between obstacle detection areas is used as a reference for determining overlap between obstacles included in both of the first obstacle information and the second obstacle information. Thus, it becomes possible to perform processing more simply and faster than determination based on differences in the positions, speeds, orientations, and the like of the detected obstacles.

Effects of Second Embodiment

As described above, in the communication device 200 and the communication method according to the second embodiment, obstacle information detected in an area overlapping with the first obstacle information of the roadside device 1 is removed from the second obstacle information detected by the on-vehicle sensor 40 of the own vehicle 3, to generate difference obstacle information. Thus, in addition to the effect of reducing the data communication amount, since the first obstacle detection area is estimated on the basis of the first obstacle information, a communication message need not be separately transmitted, and therefore an effect that the overlap obstacle information removing process can be performed more simply and faster is also provided.

Third Embodiment

Figure 7:
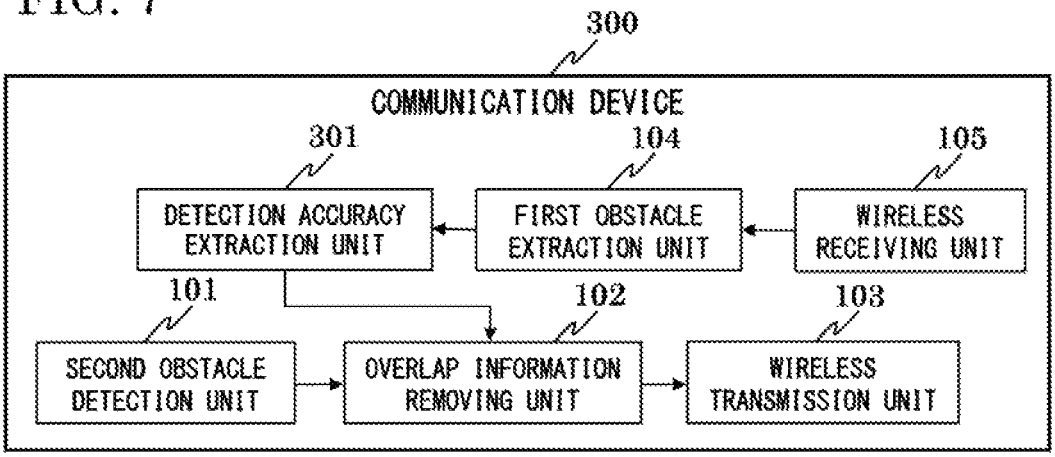
FIG. 7 is a function block diagram showing the configuration of a communication device according to the third embodiment of the present disclosure.

FIG. 7 is a function block diagram showing the configuration of a communication device 300 according to the third embodiment. The communication device 300 shown in FIG. 7 further includes a detection accuracy extraction unit 301 in addition to the configuration of the communication device 100 according to the first embodiment. Description of the same components as those in the communication device 100 according to the first embodiment is omitted.

The detection accuracy extraction unit 301 extracts, from first obstacle information extracted by the first obstacle extraction unit 104 from wireless information transmitted from another communication device, first obstacle detection accuracy which is detection accuracy when the first obstacle has been detected by a sensor provided to the other communication device. As an example, in a case where the other communication device is the roadside device 1, detection accuracy when the roadside sensor 1*a* provided to the roadside device 1 has detected the first obstacle is extracted as the first obstacle detection accuracy.

Communication Method According to Third Embodiment

Figure 8:
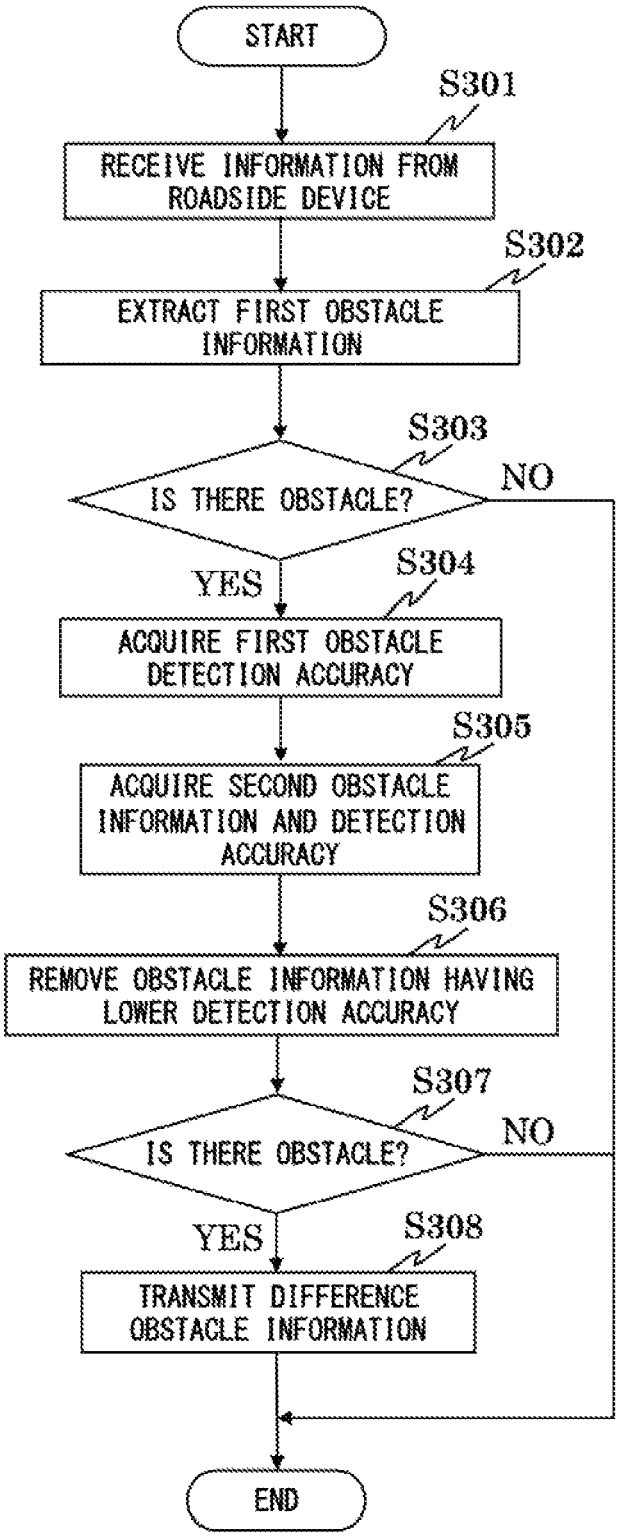
FIG. 8 is a flowchart illustrating a communication method according to the third embodiment.

With reference to a flowchart in FIG. 8, a communication method according to the third embodiment will be described. It is noted that operations in steps S301 to S303 in the flowchart in FIG. 8 are respectively the same as those in steps S101 to S103 in the flowchart in FIG. 4 of the first embodiment, and operations in steps S307 and S308 in the flowchart in FIG. 8 are respectively the same as those in steps S106 and S107 in the flowchart in FIG. 4, and therefore description thereof is omitted.

In step S304, the detection accuracy extraction unit 301 extracts first obstacle detection accuracy when the first obstacle has been detected, from the first obstacle information extracted by the first obstacle extraction unit 104 from the wireless information transmitted from the other communication device.

In step S305, the second obstacle detection unit 101 acquires the second obstacle information detected by the on-vehicle sensor 40 of the own vehicle 3. In the second obstacle information, information of second obstacle detection accuracy when the on-vehicle sensor 40 detects the second obstacle is included.

In step S306, if there is overlap obstacle information between the second obstacle information and the first obstacle information, and in the overlap obstacle information, the second obstacle detection accuracy is lower than the first obstacle detection accuracy, the overlap information removing unit 102 removes, as overlap obstacle information, the obstacle information having lower detection accuracy, from the second obstacle information, to generate difference obstacle information.

In the above description, the communication method according to the third embodiment has been described.

In the above processing by the overlap information removing unit 102 in which the obstacle information overlapping with the first obstacle information is removed from the second obstacle information, the obstacle information having higher detection accuracy is kept, thus providing an effect chat the obstacle information having higher detection accuracy can be shared with other communication devices.

Effects of Third Embodiment

As described above, in de communication device 300 and the communication method according to the third embodiment, if, in overlap obstacle information between second obstacle information detected by the on-vehicle sensor 40 of the own vehicle 3 and first obstacle information transmitted from another communication device, e.g., the roadside device 1, the second obstacle detection accuracy is lower than the first obstacle detection accuracy, the overlap obstacle information is removed from the second obstacle information, to generate difference obstacle information. Thus, in addition to the effect of reducing the data communication amount, an effect that obstacle information having high detection accuracy can be shared with other communication devices is also provided.

In the above embodiments, the configuration in which the communication device 100, 200, 300 according so each embodiment is provided to a vehicle as shown in FIG. 2 has been described as an example. However, the communication device 100, 200, 300 according to each embodiment may not necessarily be provided to a vehicle, and for example, may be provided in the roadside device 1 shown in FIG. 1.

The present disclosure is not limited to the above embodiments and various modifications may be made within the gist of the present disclosure. For example, the present disclosure is applicable to not only a communication device provided to a vehicle but also a pedestrian's communication device having a similar function (pedestrian-to-vehicle communication or pedestrian-to-roadside communication).

In the above description, the configuration in which the functions of components of the communication devices 100, 200, 300 according to the first to third embodiments are implemented by one of hardware and software, etc., has been described. However, without limitation thereto, some of the components of the communication devices 100, 200, 300 according to the first to third embodiments may be implemented by dedicated hardware, and the other components may be implemented by software, etc.

Figure 9:
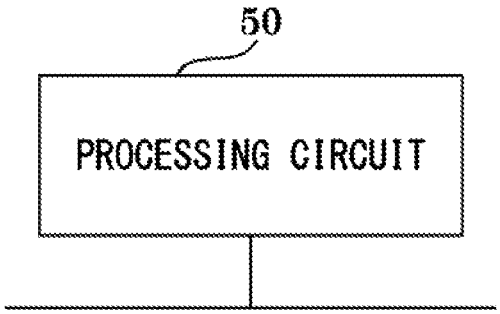
FIG. 9 is a diagram showing a hardware configuration for implementing the communication device according to each of the first to third embodiments.
Figure 10:
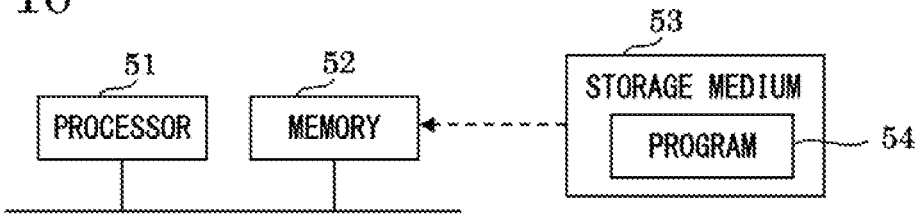
FIG. 10 is a diagram showing a hardware configuration for implementing the communication device according to each of the first to third embodiments.

For example, as shown in FIG. 9 and FIG. 10, for some components, the functions thereof may be implemented by a processing circuit 50 as dedicated hardware, and for the other components, the processing circuit 50 as the processor 51 may read and execute a program, stored in a memory 52, for causing a computer or the like to execute the communication control method according to the first to third embodiments, thereby implementing the functions of the other components.

Further, as shown in FIG. 10, setting data to be used in the function units and the like of the communication devices 100, 200, 300 according to the first to third embodiments may be installed as a part of software to the memory 52 from a storage medium 53 storing a program 54 for causing a computer or the like to execute the communication control method according to the first to third embodiments.

As described above, the communication devices 100, 200, 300 according to the first to third embodiments can implement the above-described functions by hardware, software, etc., or a combination thereof.

Although the disclosure is described above in terms of various exemplary embodiments and implementations, it should be understood that the various features, aspects, and functionality described in one or more of the individual embodiments are not limited in their applicability to the particular embodiment with which they are described, but instead can be applied, alone or in various combinations to one or more of the embodiments of the disclosure.

It is therefore understood that numerous modifications which have not been exemplified can be devised without departing from the scope of the present disclosure. For example, at least one of the constituent components may be modified, added, or eliminated. At least one of the constituent components mentioned in at least one of the preferred embodiments may be selected and combined with the constituent components mentioned in another preferred embodiment.

DESCRIPTION OF THE REFERENCE CHARACTERS

1 roadside device
1*a* roadside sensor
1*b* communication unit
2 detection area of roadside sensor
3 own vehicle
4 detection area of on-vehicle sensor
5, 5*a* other vehicle
40 on-vehicle sensor
50 processing circuit
51 processor
52 memory
53 storage medium
54 program
100, 200, 300 communication device
101 second obstacle detection unit
102 overlap information removing unit
103 wireless transmission unit
104 first obstacle extraction unit
105 wireless receiving unit
201 detection area estimation unit
301 detection accuracy extraction unit

What is claimed is:

1. A communication device comprising at least one processor configured to implement:

a wireless receiver for receiving wireless information including first obstacle information of a first obstacle which is at least one obstacle, from outside;

a first obstacle extractor for extracting the first obstacle information from the wireless information;

a second obstacle detector for detecting second obstacle information of a second obstacle which is at least one obstacle present in an own surrounding area by a sensor;

an overlap information removing circuitry which, if there is overlap obstacle information between the first obstacle information and the second obstacle information, removes the overlap obstacle information from the second obstacle information, to generate difference obstacle information; and a detection area estimator for estimating a first obstacle detection area which is an area where the first obstacle has been detected, on the basis of the first obstacle information, wherein if there is an overlap detection area between the first obstacle detection area and a second obstacle detection area which is an area where the second obstacle included in the second obstacle information has been detected, the overlap information removing circuitry removes, as the overlap obstacle information, information of the obstacle included in the overlap detection area, from the second obstacle information, to generate the difference obstacle information.

2. The communication device according to claim 1, further comprising a wireless transmitter for transmitting the difference obstacle information to outside.

3. The communication device according to claim 2, further comprising a detection accuracy extractor for extracting first obstacle detection accuracy from the first obstacle information, wherein if there is the overlap obstacle information between the second obstacle information and the first obstacle information, and for the overlap obstacle information, second obstacle detection accuracy is lower than the first obstacle detection accuracy, the overlap information removing circuitry removes the overlap obstacle information from the second obstacle information, to generate the difference obstacle information.

4. The communication device according to claim 2, the communication device being provided to a vehicle.

5. The communication device according to claim 2, the communication device being provided to a roadside device placed at a road.

6. The communication device according to claim 1, further comprising a detection accuracy extractor for extracting first obstacle detection accuracy from the first obstacle information, wherein if there is the overlap obstacle information between the second obstacle information and the first obstacle information, and for the overlap obstacle information, second obstacle detection accuracy is lower than the first obstacle detection accuracy, the overlap information removing circuitry removes the overlap obstacle information from the second obstacle information, to generate the difference obstacle information.

7. The communication device according to claim 1, the communication device being provided to a vehicle.

8. The communication device according to claim 1, the communication device being provided to a roadside device placed at a road.

9. A communication method comprising:

a wireless receiving step of receiving wireless information including first obstacle information of a first obstacle which is at least one obstacle, from outside;

a first obstacle extraction step of extracting the first obstacle information from the wireless information;

a second obstacle detection step of detecting second obstacle information of a second obstacle which is at least one obstacle present in an own surrounding area by a sensor;

an overlap information removing step of, if there is overlap obstacle information between the first obstacle information and the second obstacle information, removing the overlap obstacle information from the second obstacle information, to generate difference obstacle information; and a detection area estimation step of estimating a first obstacle detection area which is an area where the first obstacle has been detected, on the basis of the first obstacle information, wherein in the overlap information removing step, if there is an overlap detection area between the first obstacle detection area and a second obstacle detection area which is an area where the second obstacle included in the second obstacle information has been detected, information of the obstacle included in the overlap detection area is removed, as the overlap obstacle information, from the second obstacle information, to generate the difference obstacle information.

10. The communication method according to claim 9, further comprising a wireless transmission step of transmitting the difference obstacle information to outside.

11. The communication method according to claim 10, further comprising a detection accuracy extraction step of extracting first obstacle detection accuracy from the first obstacle information, wherein in the overlap information removing step, if there is the overlap obstacle information between the second obstacle information and the first obstacle information, and for the overlap obstacle information, second obstacle detection accuracy is lower than the first obstacle detection accuracy, the overlap obstacle information is removed from the second obstacle information, to generate the difference obstacle information.

12. The communication method according to claim 9, further comprising a detection accuracy extraction step of extracting first obstacle detection accuracy from the first obstacle information, wherein in the overlap information removing step, if there is the overlap obstacle information between the second obstacle information and the first obstacle information, and for the overlap obstacle information, second obstacle detection accuracy is lower than the first obstacle detection accuracy, the overlap obstacle information is removed from the second obstacle information, to generate the difference obstacle information.

* * * * *